US005173060A

United States Patent [19]

Shimirak et al.

[11] Patent Number: 5,173,060

[45] Date of Patent: Dec. 22, 1992

[54] TELECOMMUNICATIONS TERMINAL BLOCK OR ADAPTER

[75] Inventors: Gerald L. Shimirak, Danville; Paul S. Chan, San Francisco, both of Calif.

[73] Assignee: Raychem Corporation, Menlo Park, Calif.

[21] Appl. No.: 537,205

[22] Filed: Jun. 12, 1990

Related U.S. Application Data

[63] Continuation-in-part of Ser. No. 231,775, Aug. 12, 1988, abandoned, which is a continuation-in-part of Ser. No. 164,261, Mar. 4, 1988, abandoned, and a continuation-in-part of Ser. No. 164,301, Mar. 4, 1988, abandoned.

[51] Int. Cl.[5] ..... H01R 4/24

[52] U.S. Cl. ..... 439/416; 439/727; 439/797

[58] Field of Search ..... 439/389, 419, 709–715, 439/717, 718, 721, 723–725, 727, 728; 29/857, 865, 866, 867

[56] References Cited

U.S. PATENT DOCUMENTS

| | | | |
|---|---|---|---|
| 426,204 | 4/1890 | Munsie . | |
| 1,046,465 | 12/1912 | Hoyt | 439/507 |
| 2,267,449 | 12/1941 | Eby | 173/340 |
| 2,372,653 | 4/1945 | Becket | 173/340 |
| 2,654,857 | 10/1953 | Finkel | 317/62 |
| 2,911,615 | 11/1959 | Popejoy et al. | 339/198 |
| 3,016,510 | 1/1962 | Blonder | 339/97 |
| 3,052,866 | 9/1962 | Koch | 339/202 |
| 3,129,048 | 4/1964 | Broch | 339/97 |
| 3,150,909 | 9/1964 | Westfield | 339/97 |
| 3,154,363 | 10/1964 | Will | 439/415 |
| 3,487,354 | 12/1969 | Duncan | 339/98 |
| 3,530,425 | 9/1970 | Vachhani | 339/95 |
| 3,573,692 | 4/1971 | Stetson | 439/510 |
| 3,657,503 | 4/1972 | Smith | 439/510 |
| 3,688,246 | 8/1972 | Toedtman et al. | 339/95 A |
| 3,771,104 | 11/1973 | Clark | 439/415 |
| 3,909,097 | 9/1975 | Roth et al. | 439/511 |
| 4,345,806 | 8/1982 | McHenney | 439/510 |
| 4,423,918 | 1/1984 | Filreis et al. | 339/97 P |
| 4,470,652 | 9/1984 | Schwab | 439/509 |
| 4,634,207 | 1/1987 | Debbaut | 339/116 |
| 4,734,061 | 3/1988 | Randall | 439/271 |

FOREIGN PATENT DOCUMENTS

| | | |
|---|---|---|
| 0256167A2 | 2/1988 | European Pat. Off. . |
| 501100 | 6/1930 | Fed. Rep. of Germany . |
| 2256657 | 5/1974 | Fed. Rep. of Germany . |
| 558301 | 8/1923 | France . |
| 587574 | 4/1925 | France . |

*Primary Examiner*—David L. Pirlot

*Attorney, Agent, or Firm*—Herbert G. Burkard; William D. Zahrt, II; A. Stephen Zavell

[57] ABSTRACT

A terminal block, by means of which a multi-core cable is connected to several drop wires, may be repaired by positioning an adapter over its binding posts. The adapter has an aperture into which a non-stripped, non-split, multi-core drop wire can be inserted such that one core of the drop wire is adjacent one binding post. Caps are then screwed onto the binding posts to make contact with respective cores, prebinding posts to make contact with respective cores, preferably by cutting through insulation of the drop wire. The adapter may be adjustable to suit different sizes of terminal block.

47 Claims, 15 Drawing Sheets

TELECOMMUNICATIONS TERMINAL BLOCK OR ADAPTER

RELATED APPLICATION

This application is a continuation-in-part of application Ser. No. 07/231,775 filed Aug. 12, 1988 now abandoned, the disclosure of which is incorporated herein by reference, which is a is a continuation-in-part of U.S. Ser. No. 07/164261 and 07/164301 filed Mar. 4, 1988 now abandoned (Shirmirak/Chan) the disclosures of which are incorporated herein by reference.

FIELD OF THE INVENTION

This invention relates primarily to telecommunications terminal blocks by means of which multi-core cables, often containing many tens or hundreds of conductor pairs, may be terminated for final connection to drop wires that lead to individual subscriber's telephones, and for convenience will be described in such terms. The invention may, however, be useful for making other similar electrical connections.

BACKGROUND OF THE INVENTION

Various types of terminal blocks have been used in the telecommunications industry which provide some means for anchoring an incoming multi-core cable and which have a number of pairs of conductors, known as binding posts, to a base of each of which a conductor of the cable is more or less permanently connected. A top part of each binding post protrudes above an upper surface of the block, and is screw-threaded. A stripped drop wire may be wrapped around the exposed binding post and secured with a washer and nut, thus making a breakable electrical connection between a core of the incoming cable and the drop wire. A terminal block may typically provide for connections to up to 25 pairs of conductors, a pair of conductors of course being required for each telephone.

Several problems may arise with such terminal blocks, in particular corrosion. The binding posts, washer and nuts, and drop wires are liable to corrosion and other environmental damage which results in interference and cross-talk etc. on telephone lines. Provision of a permanent seal around the binding posts or around the whole block is generally not practical since access to the conductors for testing of the lines or for rearrangement of the lines may be required. An excellent re-enterable technique for encapsulation of binding posts is marketed by Raychem under the trademark Termseal, and is disclosed in U.S. Pat. No. 4,634,207, the disclosure of which is incorporated herein by reference. This technique generally requires however, that badly corroded binding posts be properly cleaned and that new washers and nuts be employed before the technique is carried out. That may not always be convenient or possible to ensure.

A further problem is inherent in the design of prior art terminal blocks, in that they require that the drop wires be pre-stripped at their ends before connection to the binding posts. Also, in the case of multi-core drop wires (generally two cores side-by-side, giving the drop wire an oval or almost rectangular cross-section), the drop wire has to be split, i.e. its cores separated for separate connection to spaced-apart binding posts. Thus the wire is split in two, and insulation removed from each of the resulting two wires, and connection then made to the binding posts, after cleaning in the case of repair to an installed block.

The present invention is able to overcome such problems as these by providing an article and a method whereby a non-stripped, non-split, multi-core drop wire can be connected to an existing, prior art terminal block (an exercise that may be referred to as rehabilitation) and preferably to terminal blocks of different binding post separation. The invention also provides a new terminal block whereby such multi-core drop wires may be connected to a multi-core telecommunications cable.

SUMMARY OF THE INVENTION

The present invention therefore provides an adapter by means of which cores of a multi-core drop wire can be connected to a pair of binding posts of a terminal block, which comprises:

(a) two caps that can be received on respective binding posts; and (b) a housing having:

(i) two first apertures each extending from a first surface to a second surface of the housing, the housing being positionable with the first surface adjacent the terminal block and the binding posts within respective said first apertures such that the posts can receive respective caps at the second surface, the caps extending within respective said first apertures; and (ii) a second aperture that passes between, and is in communication with each of, said first apertures, the second aperture being capable of receiving said drop wire such that respective cores thereof pass through respective first apertures and are contacted by respective caps when received by respective binding posts within the first apertures.

The invention also provides a terminal block by means of which conductors of a multi-core cable can be connected to the cores of at least two multi-core drop wires, which comprises a housing having:

(a) a first pair of binding posts, to respective posts of which respective cores of a first said drop wire can be connected, each post having means for connection to a conductor of said cable;

(b) a second pair of binding posts, to respective posts of which respective cores of a second said drop wire can be connected, each post having means for connection to a conductor of said cable; each binding post being capable of receiving a cap, such that when the cap is received by a binding post and over said drop wire adjacent the binding post contact is made to a core of the drop wire;

(c) a first aperture that passes between binding posts of the first pair, the aperture being capable of receiving a first said drop wire such that respective cores of the drop wire are adjacent respective binding posts of the first pair and can be individually contacted by caps thereon; and (d) a second aperture that passes between binding posts of the second pair, the aperture being capable of receiving a second said drop wire such that respective cores of the drop wire are adjacent respective binding posts of the second pair and can be individually contacted by caps thereon.

The invention further provides a method of connecting a multi-core drop wire to a terminal block having a pair of binding posts, by means of an adapter comprising two caps and a housing, the housing having:

(i) two first apertures each extending from a first surface to a second surface of the housing; and (ii) a second aperture that passes between, and is in communication with each of, said first apertures, the second aperture being capable of receiving said drop wire such that respective cores thereof pass through respective first apertures;

which method comprises:

(A) positioning the housing on the terminal block with the first surface adjacent the block and the binding posts within respective said first apertures;

(B) positioning the drop wire within the second aperture; and (C) positioning the caps on respective binding posts at the second surface such that the caps extend within respective said first apertures and contact respective cores of the drop wire.

The invention further provides a terminal block by means of which a conductor of a multi-core cable can be connected to the core of a drop wire, which comprises a housing having:

(a) a terminal to which the core of said drop wire can be connected, the terminal having means for connection to a conductor of said cable;

the terminal having a female screw-thread and being capable of receiving a cap having a male screw-thread, such that when the cap is received by the terminal and over said drop wire adjacent the terminal contact is made to a core of the drop wire;

(b) a first aperture that passes adjacent the terminal, the aperture being capable of receiving said drop wire; and (c) said cap having a male thread and that can be received by the terminal.

The invention further provides a cap suitable for use on a terminal block housing for connecting an insulated drop-wire to a terminal of the housing, which cap comprises:

(a) a body having a male screw-thread;

(b) a recess around the screw-thread;

(c) a sealing material in the recess;

(d) an insulation-displacement cutting edge around the screw-thread.

The invention further provides a terminal block by means of which conductors of a multi-core cable can be connected to the cores of a multi-core drop wire, which comprises a housing having:

(a) a pair of binding posts, to respective posts of which respective cores of a first said drop wire can be connected, each post having means for connection to a conductor of said cable;

each binding post having a female screw-thread and being capable of receiving a cap having male screw-thread, such that when the cap is received by a binding post and over said drop wire adjacent the binding post contact is made to a core of the drop wire;

(b) an aperture that passes between the binding posts, the aperture being capable of receiving said drop wire such that respective cores of the drop wire are adjacent respective binding posts of the first pair and can be individually contacted by caps thereon.

The invention also provides an adapter that may be used over binding posts of different separation, and thus an adjustable or variable adapter is provided.

Thus, the invention further provides an adapter as defined above, in which the housing comprises first and second parts;

the first part having therein one of said first apertures and a portion of said second aperture;

the second part having therein another of said first apertures and another portion of said second aperture;

the first part being moveable relative to the second part.

The invention still further provides an adapter by means of which cores of a multi-core drop wire can be connected to a pair of binding posts of a terminal block, which comprises:

a housing having:

(i) two first apertures extending from a first surface to a second surface of the housing, the housing being positionable with the first surface adjacent the terminal block and the binding posts within respective said first apertures; and (ii) a second aperture that passes between, and is in communication with each of, said first apertures, the second aperture being capable of receiving said drop wire such that respective cores thereof pass through respective first apertures;

the housing comprising first and second parts;

the first part having therein one of said first apertures and a portion of said second aperture;

the second part having therein another of said first apertures and another portion of said second aperture;

the first part being connected to and movable relative to the second part from a first relative position to a second relative position in each of which relative position axes of the two first apertures are substantially mutually parallel, and axes of said portion and of said other portion of the second aperture are substantially mutually parallel.

The invention yet further provides an adapter by means of which a core of a multicore dropwire can be connected to a binding post of a terminal block, which comprises:

a housing having:

(i) a first aperture extending from a first surface to a second surface of the housing, the housing being positionable with the first surface adjacent the terminal block and the binding post within the first aperture; and (ii) a second aperture that passes adjacent, and is incommunication with, said first aperture the second aperture being of non-circular cross-section and breaking into the first aperture to such an extent that less than 67% (preferably less than 50%) of a transverse dimension of the second aperture lies within the first aperture. (The words "first" and "second" in the context, for example, of first and second apertures are mere labels and do not imply a difference in shape etc. The second aperture of the adapter is in fact, generally equivalent to the first aperture of the terminal block.)

The term "binding post" will be readily understood by those skilled in the art. The term means a terminal, generally small and screw threaded, used to make electrical connections to wires. Usually a binding post is part of a terminal block. Prior art binding posts have a male screw-thread, i.e. have the form of bolts, and nuts are screwed over them to secure wires for electrical connection. In the present invention caps, (having a female screw-thread, i.e. having the form of nuts but optionally also having for example insulation-displacement means or recesses for holding sealing material) may be used on such binding posts. As will be clear from the text, the term "binding post" (and the term "terminal") is used herein also to include a connection means that has a female screw-thread (i.e. has the form of a nut) and into which a cap, having the form of a bolt, may be screwed. This type of binding post (see FIG. 8) may be mounted in a hole in a terminal block, for use with a cap such as that shown in FIG. 9.

DETAILED DESCRIPTION OF THE INVENTION

The housing of the adapter of the invention preferably comprises a block of insulating, generally plastics, material whose first and second surfaces are substantially planar (but may have recesses in them for receiving sealing material etc.) and are mutually parallel. The first and second surfaces will generally have a major dimension of 2–10, especially 3–6 cm, and a minor dimension of 1–5, especially 1.5–3 cm. The separation between the first and second surfaces, i.e. the thickness of the block, is preferably 0.5–3, especially 0.75–1.5 cm. Where the adapter is used for rehabilitation of terminal blocks such as Western Electric 9Al or TII Model 325 the block is preferably about 2.5×4 cm by 1.0 cm thick. Several such blocks can be positioned side-by-side over several pairs of binding posts, the pairs being about 2.5 cm apart, and the posts of each pair about 2.2 cm apart.

The housing may be specially shaped such that two or more can be positioned side-by-side in substantially close packing arrangement: its first and second surfaces may be thought of being rectangular with one or more corners removed to allow this close-packing, bearing in mind that a stiff drop wire emerging from the second aperture may have to be accommodated. The housing may therefore have first and second sides that extend between the first and second surfaces, the drop wire emerging, say, from an opening in the second side. The first side will then preferably have a substantially similar shape (at least as seen in plan view of the housing) to the combined shape of the second side plus a substantially straight drop wire extending therefrom.

The second aperture is preferably straight since the drop wire may be stiff, and thus difficult to insert into a curved aperture, particularly if, as is preferred, the drop wire is a close fit in the aperture. The aperture is preferably elongate and closed in transverse cross-section (although it may, for example, comprise an open channel). This is because such an aperture may be better able to locate the drop wire with respect to the first apertures and therefore to the binding posts for proper contact with the caps. We prefer that the second aperture is of non-circular cross-section such that the cores of a multi-core drop wire therein of non-circular cross-section are maintained in fixed orientation with respect to the first apertures, and therefore to the binding posts.

The first apertures are preferably each of closed, more preferably circular, cross-section. Each first aperture may be of smaller diameter (preferably substantially equal to that of a binding post) at the first surface, and of larger diameter at the second surface. That larger diameter is preferably substantially equal to the diameter of a part of the cap that the aperture will receive when the cap is positioned on the binding post when received by the aperture. The aperture is thus stepped, and the transition from larger to smaller diameter limits the extent to which the cap is received on the binding post, and thus may prevent damage to the underlying drop wire. Other means may, however, be provided for limiting travel of the cap on the binding post, for example a closed end of the cap may ground on the top of the post.

The caps preferably include insulation displacement means, for example a cutting bottom edge. Thus, as they are brought down over the binding posts they cut into the insulation of the underlying drop wire. It is desirable that they cut through the insulation, and cannot be advanced sufficiently further that they excessively damage the cores of the drop wire. Hence, the preferred means for limiting travel mentioned above. Thus, the second aperture may break into the first aperture at the above-mentioned transition of diameters, such that a core of a drop wire in the second aperture lies predominately in the part of smaller diameter whereas the insulation to be displaced lies in the part of larger diameter and is therefore accessible to the insulation displacement edge of the cap.

The binding posts and caps are preferably screw-threaded, so that caps are simply screw-threaded down onto the posts. The insulation means its then preferably an annular cutting edge, that overlaps one core, but not both cores, of the drop wire. The second aperture may therefore pass obliquely between two binding posts such that one edge of a drop wire therein lies adjacent one post and the opposite edge lies adjacent the other post. When the caps are screwed down over the posts, one cuts into one half of the drop wire, and the other into the other half, thus making contact to the cores. We prefer that slackening-off of the caps results in breaking of contact to the cores, particularly without complete removal of the caps. This allows independent testing of a circuit from the terminal block back to the central office, or on to the subscriber by selective slackening-off of one of the caps from a pair of binding posts.

A sealing material may be provided that encapsulates the binding posts, caps and/or drop wires to provide further environmental sealing, although the need for such sealing material may be reduced in the present invention since the vulnerable surfaces and the connections to be made may be buried within the housing.

A preferred sealing material comprises a gel, for example based on polyurethane or silicone. As an example a material may be mentioned that is made by gelling curable polyurethane precursor materials in the presence of substantial quantities of mineral oil, vegetable oil or plasticizer or a mixture of two or more of them. Also, a suitable material may be made by curing reactive silicones with non-reactive extender silicones. The material may contain additives such as moisture scavengers (e.g. benzoyl chloride), antioxidants, pigments and fungicides. The material is preferably electrically-insulating and hydrolytically-stable.

We prefer that the sealing material have a cone penetration value as measured by ASTM D217-68 at 21° C. of 100–350 ($10^{-1}$ mm), more preferably 150–350, especially 200–300 ($10^{-1}$ mm). Cone penetration is measured on an undisturbed sample using a standard 1:1 scale cone (cone weight 102.5 g, shaft weight 47.5 g) the penetration being measured after 5 seconds. The material preferably has an ultimate elongation as measured by ASTM D638-80 at 21° C. of at least 200%, preferably at least 500%, especially at least 750%. In the measurement of elongation, a Type 4 die is used to cut the sample, and elongation is measured at 50 cm per minute. We have found that with such materials it is possible to provide excellent encapsulation of the binding posts, caps and/or drop wires etc., particularly if the material is maintained under compression around them, but that it can be substantially cleanly removed from them for inspection or repair etc. Such sealing material may be provided within the caps, or within recesses in the housing.

The terminal block of the invention may incorporate any of the relevant features described above in connection with the adapter. In general, the terminal block will comprise a housing having at least 2 pairs, preferably 2–25, more preferably 2–10, especially 5 or 6 pairs of binding posts. Each pair of binding posts will have associated with it an aperture that can receive a drop wire as described above. The terminal block may have means, such as a recess, for accommodation of an end of a multi-core cable, and may have means for providing strain relief to the cable. It may be housed in an enclosure.

BRIEF DESCRIPTION OF THE DRAWINGS

FIG. 1 shows a prior art terminal block 1 comprising a housing 2 carrying five pairs of binding posts 3. A drop wire 4 is shown connected to a binding post by means of washers 5 and a nut 6.

Figure 1:
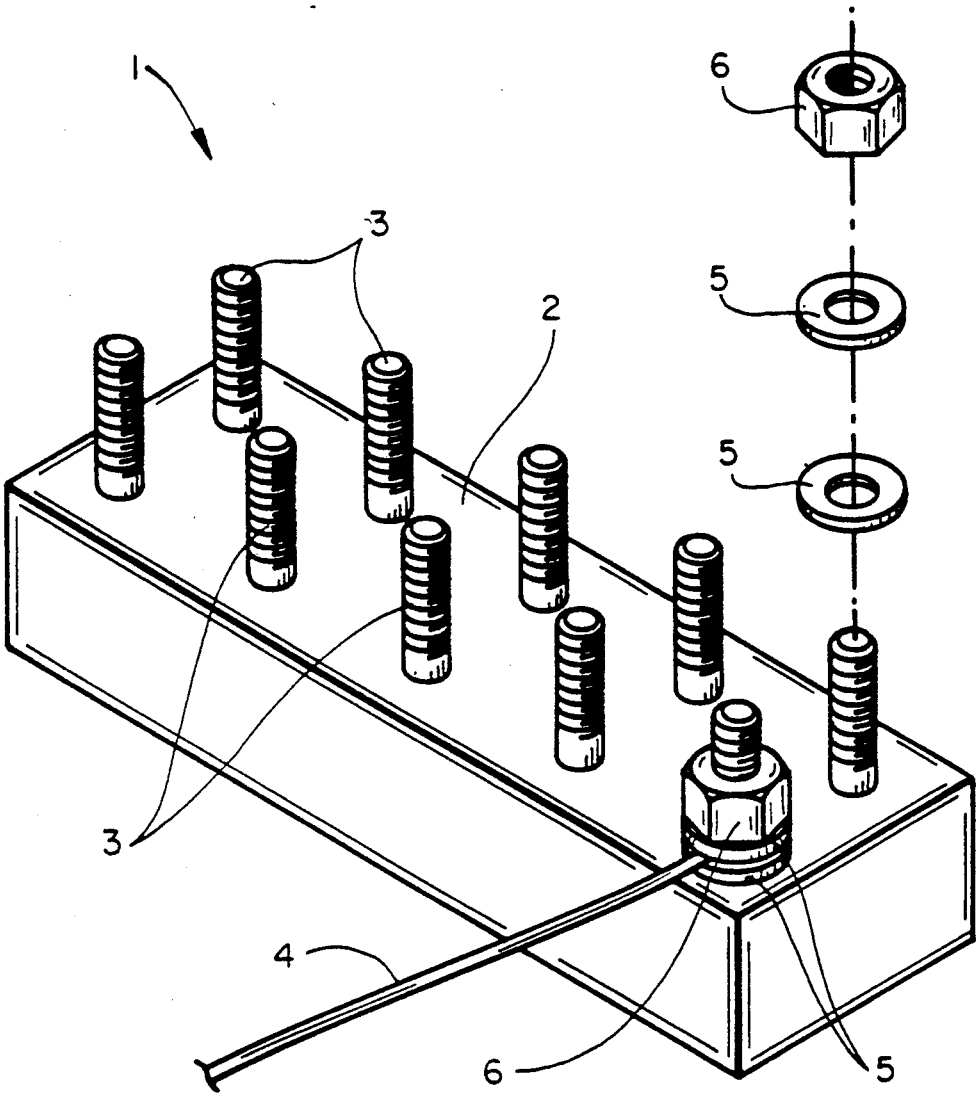
FIG 1 (PRIOR ART)
FIG. 1 shows a prior art terminal block.
Figure 2:
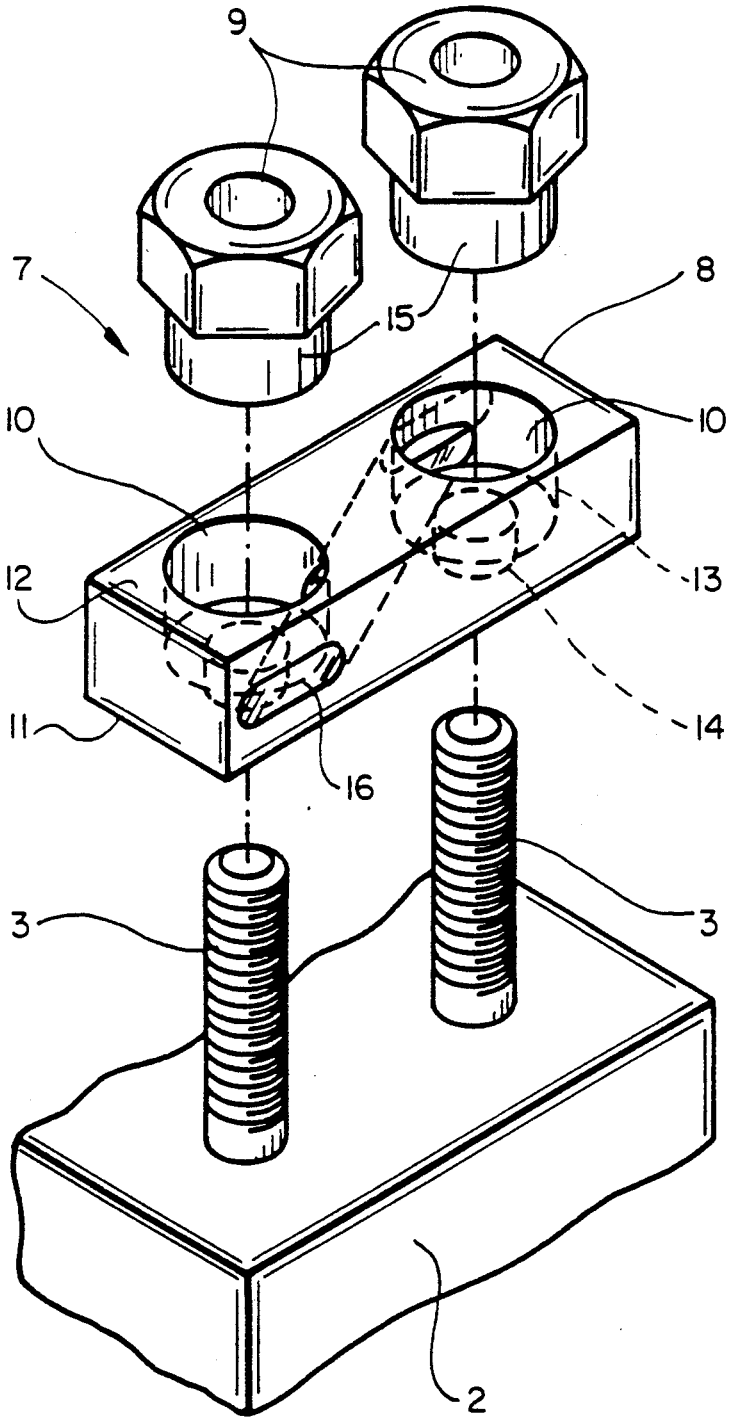
FIG. 2 shows an adapter of the invention used for rehabilitation of a prior art terminal block.

An adapter 7 of the invention is shown in FIG. 2, in position ready to be placed over binding posts 3 of a prior art terminal block housing 2. The adapter 7 comprises a housing 8 and caps 9. The housing 8 has two first apertures 10 extending from a first surface 11, which will lie adjacent the terminal block, to a second surface 12. The first apertures have greater size 13 at the second surface 12, and smaller size 14 at the first surface 11. The greater size 13 is for accommodation of a part 15 of the caps 9, and the smaller size 14 is for accommodation of the binding posts 3. A second aperture 16 passes between, and is in communication with each of, the first apertures. A multi-core drop wire may be positioned in the second aperture, such that respective cores of the drop wire pass through respective first apertures. Thus, when the caps 9 are positioned over the binding posts, parts 15 thereof will contact the respective cores, if necessary after first passing through the drop wire insulation. The second aperture preferably breaks into the first aperture to such an extent that less than 67% (more preferably less than 50%) of a transverse domension of the second aperture lies within the first aperture. In this way only one core of a two core drop wire will lie within any given first aperture and be capable of being contacted by any given cap.

The adapter may have more than two first apertures, and may have more than one second aperture.

The adapter may be used in conjunction with means for providing electrical protection to the circuits to be connected, for example against lightning strikes. Such protection may comprise a block that is first positioned over the binding posts, and which has its own binding posts over which the adapter is in turn positioned. The protection may operate by switching high voltages to ground.

Figure 3:
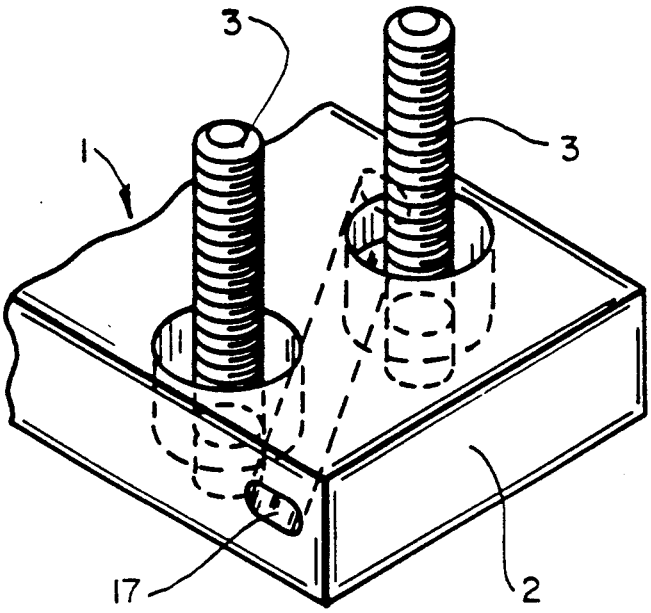
FIG. 3 shows a terminal block housing of the invention.

A terminal block 2 of the invention is shown in FIG. 3. This block 2 may be regarded as similar to a series of adapters having binding posts 3 fixed thereto. A first terminal block aperture 17 can be seen to pass between the binding posts 3, and is capable of receiving a multi-core drop wire such that respective cores thereof are adjacent respective binding posts. Reference to the first aperture passing between the binding posts is to be taken to include a situation where the binding posts stop short of the level in the block of the aperture, or in other words where the aperture is above (as drawn) the tops of the binding posts. In this case the caps may have threaded portion that extend down below a part that engage the drop wire in order to meet the binding posts. The situation illustrated (namely where the aperture lies between the top and the bottom of each post) will be preferred where the binding posts have the form of bolts, and the caps have the form of nuts. Where, however, the binding posts have the form of nuts and the caps have the form of bolts, the aperture will preferably be positioned above the tops of the binding posts. The terminal block preferably has from 2–25 pairs of binding posts, only one pair being shown. The conductors of a multi-core cable to be connected to drop wires may be connected to the binding posts in any suitable way, for example by soldering to their bases.

Figure 4:
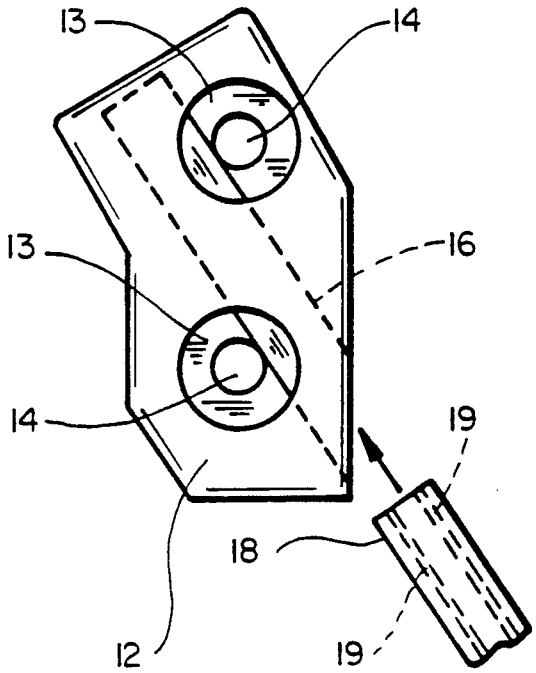
FIG. 4 is a plan view of a preferred adapter housing, together with a drop wire.

FIG. 4 is a plan view of a preferred adapter housing 12 of the invention. The two parts 13, 14 of the first apertures can be seen, as can the path of the second aperture 16. A multi-core drop wire 18, having two conductor cores 19, is shown ready to be slid into the aperture 16. The adapter housing 12 is shaped in FIG. 4 to provide a better fit when several such housings are placed side-by-side on a terminal block. This is shown in FIG. 5.

Figure 5A:
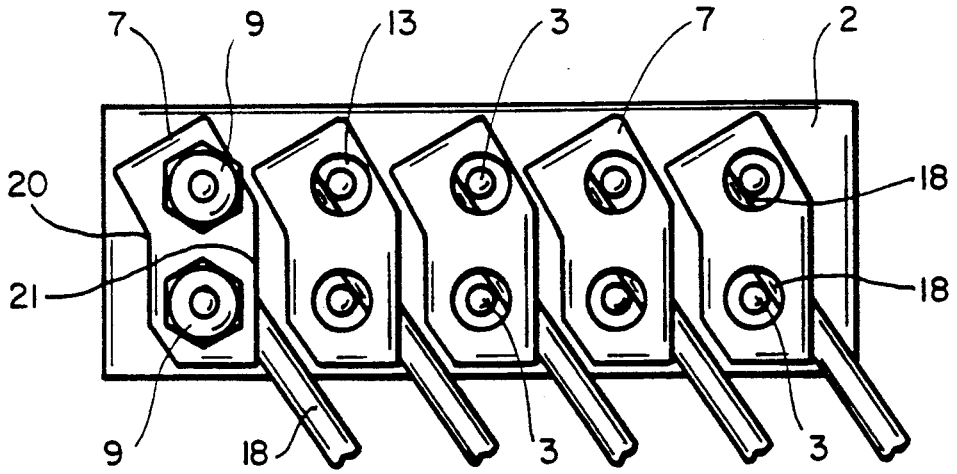
FIGS. 5A and 5B are views of terminal blocks, fitted with adapters and drop wires.

In FIG. 5A, five adapter housings 7 are positioned over five pairs of binding posts 3 on a terminal block housing 2. The left hand adapter housing 7 is shown with caps 9 in place. Drop wires 18 are shown extending into the adapter housings, and the housings can be seen to be shaped to allow a substantially close packing arrangement, their lower left-hand corners cut-away to accommodate drop wires of adjacent housings. Thus, first side 20 of each terminal block has a substantially similar shape to the combined shape of a second side 21 plus a substantially straight drop wire 18 extending therefrom.

Figure 5B:
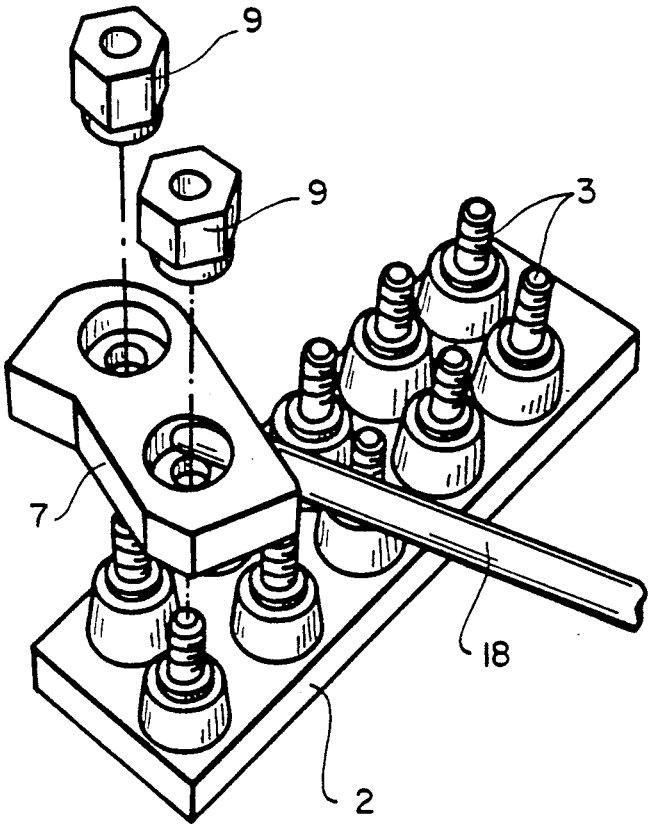

The design of FIG. 5B is similar to that of FIG. 5A, but the binding posts of each pair are staggered along the length of the block. This allows the drop wires to leave the adaptors on the block in a direction substantially perpendicular to the long sides of the block. A close-packing arrangement of the adaptors may still be achieved.

Figure 6:
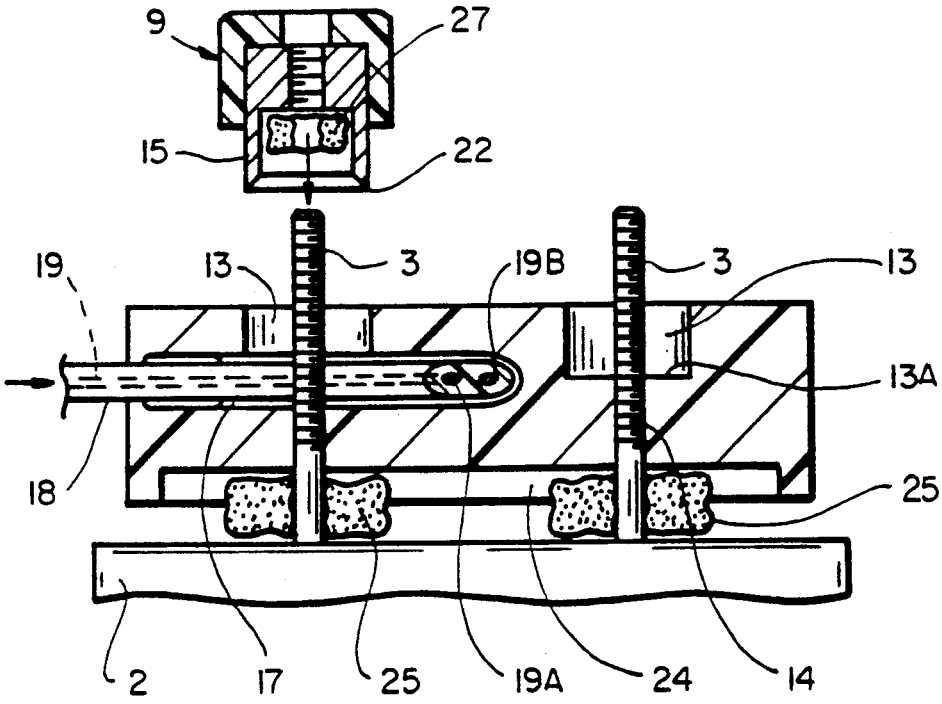
FIG. 6 is a section through a partially assembled adapter of the invention.

FIG. 6 is a partial section through a part of an adapter having a drop wire 18 inserted therein, and positioned over a terminal block housing 2 and binding posts 3. The drop wire 18 can be seen within aperture 17 and passing behind the left-hand binding post 3 such that core 19A will be contacted by cap 9 when screwed down over that binding post. The drop wire 17 then passes out of the section in front of, and adjacent the right-hand binding post. Core 19B will be contacted by a cap on that binding post.

The cap 9 can be seen to have an internal screw thread, which engages screw threads of the binding post 3. The cap also has a part 15 that will extend into an upper part 13 of the first aperture, a base of the part 15 having an insulation displacement cutting edge 22 that cuts through insulation of the drop wire to contact a core thereof. The cutting edge 22 is prevented from severing a core by its grounding on the base 13A of the wide upper part 13 of the first aperture. The cap may be provided with a sealing material such as a gel, preferably in the form of a collar 23.

The adapter housing may have a recess 24 within which may be positioned a sealing material such as a gel, again preferably in the form of a collar 25. When the caps are tightened down onto the binding posts, the adapter housing is forced against the terminal block housing 2, thus causing the sealing material to be displaced around the surfaces of the binding posts, cap and drop wire. The sealing material may be retained under compression by some means for example by the extent to which the cap is tightened on the binding post. When the cap is in position it can be seen to make electrical connection from the core of the drop wire to the binding post, which in turn may be connected to a conductor of a multi-core telecommunications cable. The contact between the cap and the core may be maintained by some resilient bias, for example that provided by compression of the insulation of the drop wire under the core, or by other means.

Figure 7:
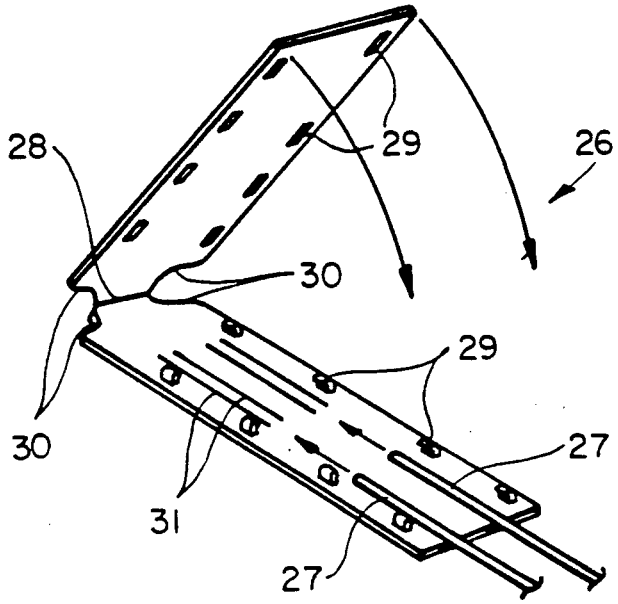
FIG. 7 shows a holding means that may be used with two single core drop wires, for insertion into the adapter.

The adapter and terminal block of the invention may be used with stripped multi-core drop wires or with pairs of single core drop wires. If desired, some means may be provided to hold two such single core drop wires in proper position relative to one another, for example by providing some holding means that may be folded around the pair or into which the pair may be slid. In this way, a multi-core drop wire may be said to be formed from single core wires. The insulation-displacing caps may then cut through this holding means in the same way that it cuts through the insulation of a two-core drop wire. We prefer that this holding means can be folded around the pair and that two parts of it can snap together, optionally causing the drop wires to be cut to length. A holding means 26 is illustrated, together with a pair of drop wires 27 in FIG. 7. It may have a live hinge 28, means 29 for locking it closed, cutting means 30 for cutting the wires 27 to length, and means 31 for locating the wires.

Figure 8:
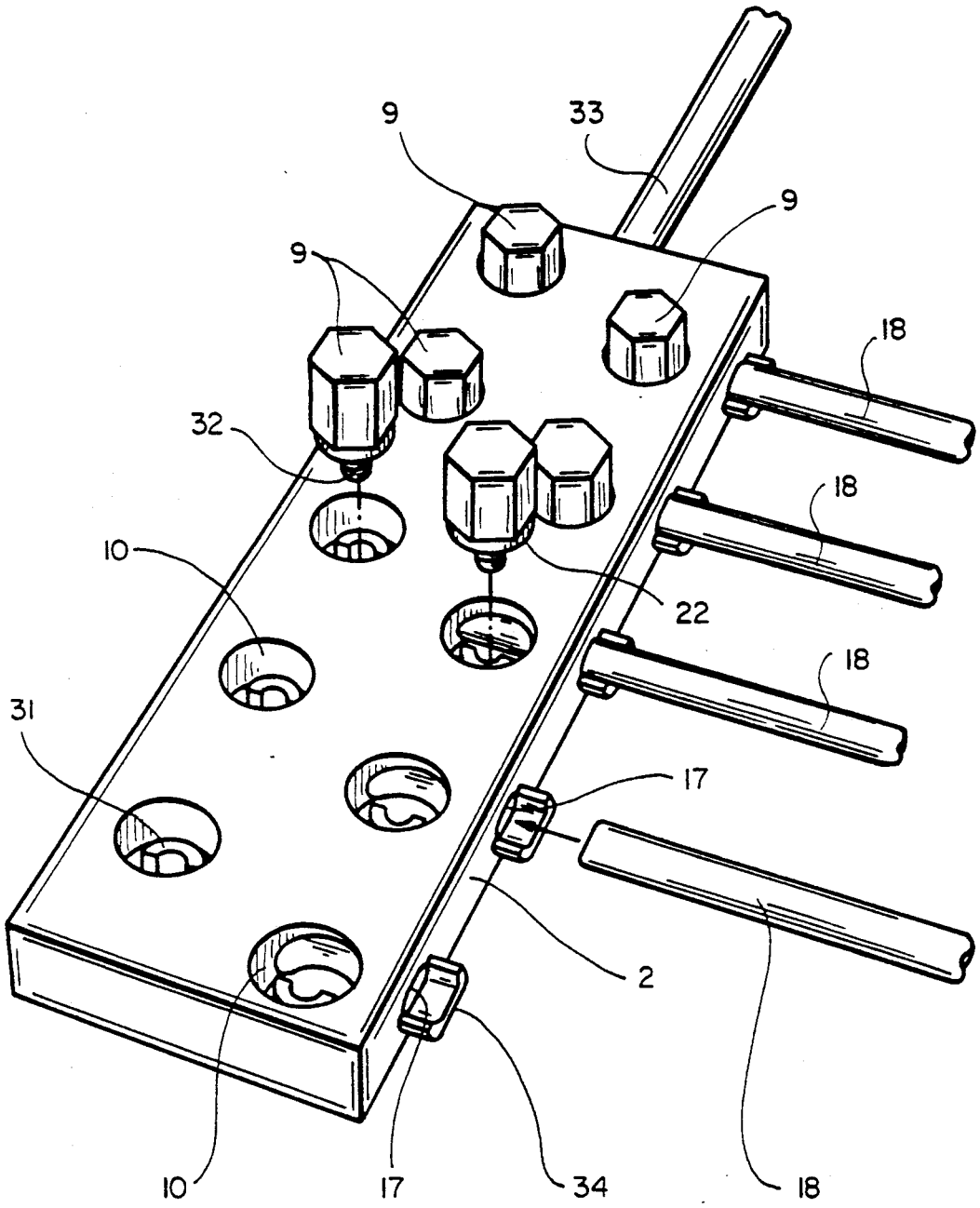
FIG. 8 shows a terminal block.

FIG. 8 shows a novel terminal block 2 having female screw-threaded binding posts 31. The caps 9 have male screw-threads 32, which can be screwed into the binding posts 31. The caps may also have an insulation-displacement cutting edge 22. Drop wires 18 are shown entering apertures 17. The conductors of a multi-core cable 33 may be connected to the posts 31 at the base of the block 2. The binding posts 31 may lie flush with bases of apertures 10 in which case the threads 32 will extend below edges 22 of the caps. Alternatively, the posts 31 may extend above the bases of the apertures 10 (as drawn), in which case the threads 32 need not extend below edges 22. Drop wire guide or support means 34 are also shown.

Figure 9A:
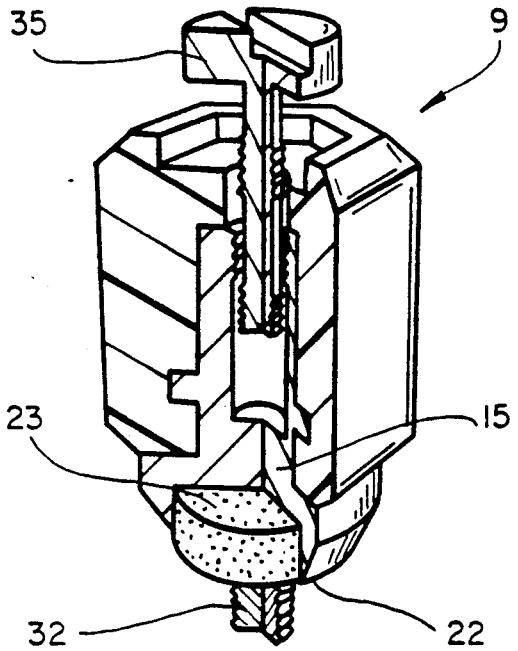
FIG. 9A and 9B show caps for the terminal block of FIG. 8.
Figure 9B:
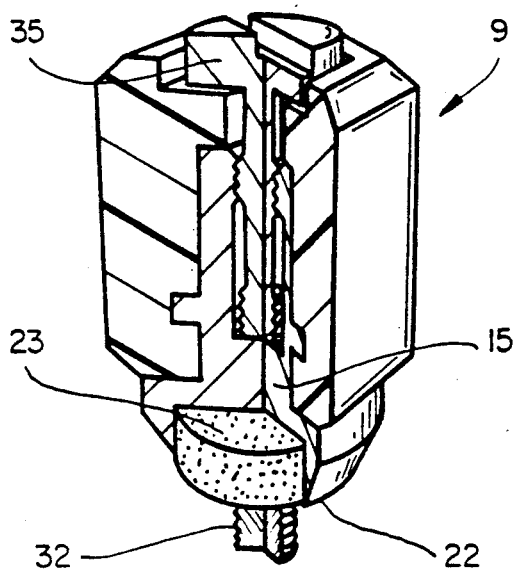

FIGS. 9A and 9B show, in partial section, a preferred cap 9 having male screw-threads 32. The cap has an insulation cutting edge 22 and a sealing material 23. The block (or adapter) with which such caps are used need be provided with no sealing material, since where desired it can be supplied in the caps. Thus, if sealing material becomes ineffective or partially lost, a new cap, pre-filled with sealing material, can be used. The cap may be provided with means 35, for example as a screw-threaded or other plug, that can make and break electrical connection between the external screw threads 32 and the insulation cutter 22. Thus, in the configuration of FIGS. 9A the means 35 is partially removed thus breaking connection between threads 32 and cutter 22, thus breaking connection between the multi-core cable and the drop wire. In FIG. 9B the means 35 is screwed home, thus making the connection. This make and break capability may be useful for selective testing of different parts of a telephone circuit employing a terminal block of the invention. Alternatively, breaking of the contact may require slight unscrewing of the cap 9, the means 35 being provided merely to cover a hole in the cap, which hole may serve to provide a contact point for a testing probe.

FIGS. 10–13 illustrate adapters having a variable separation between first aperture thereof. Such an adapter preferably has two first apertures but may have more.

Figure 10:
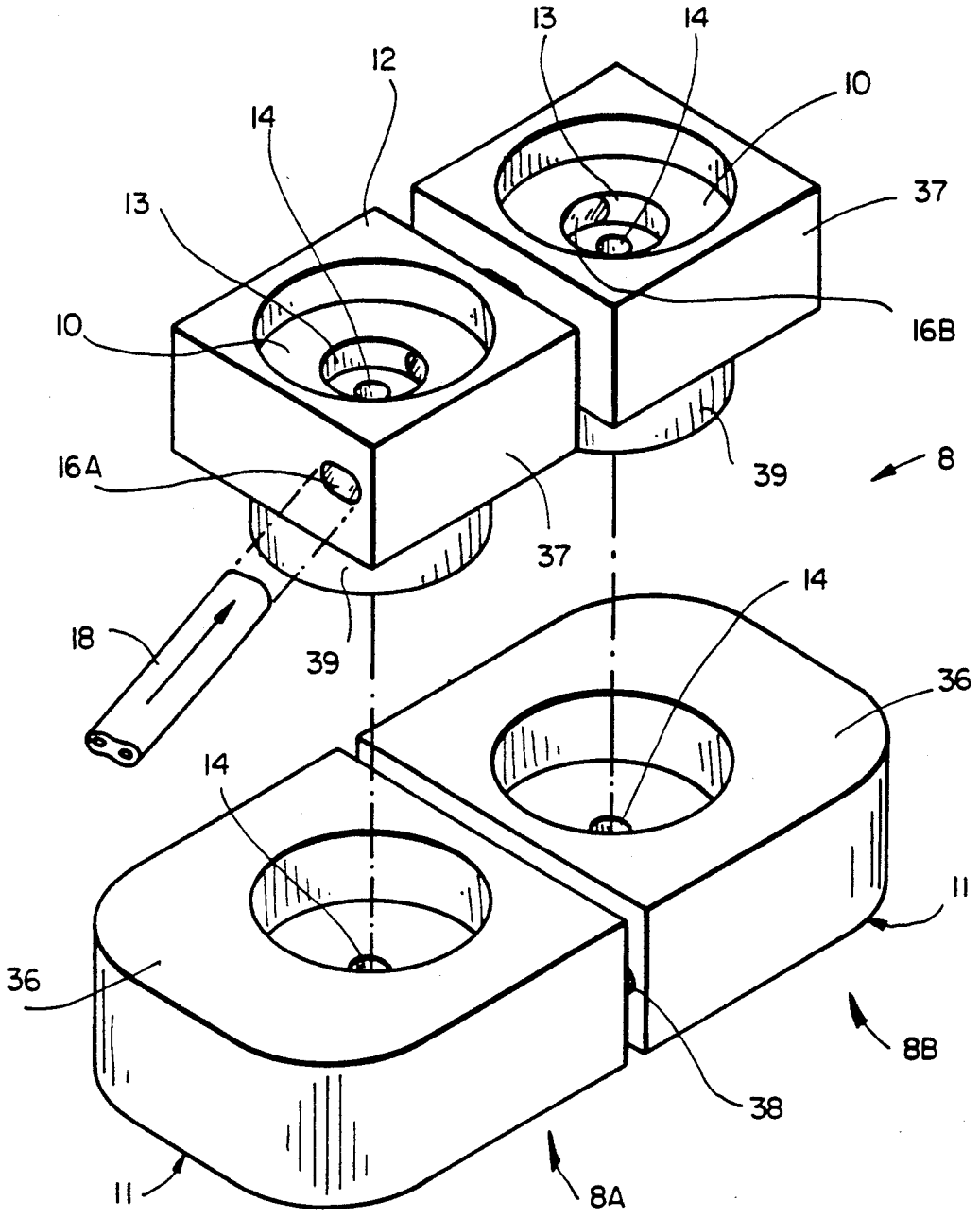
FIGS. 10, 11A, 11B, 12 and 13 show an adapter that can be adjusted to suit different binding post separations.

FIG. 10 illustrates in disassembled form an adapter comprising a housing 8 having two parts, a first part 8A at the left-hand side of the figure and a second part 8B at the right hand side of the Figure. One first aperture 10 runs through the first part 8A and a second first aperture 10 runs through the second part 8B. Each of the first and second parts 8A, 8B comprises a base 36 and a wire-holder 37. A portion 16A of the second aperture lies in the wire holder 37 of the first part 8A and another portion 16B lies within the wire-holder 37 of the second part 8B. Generally, the second aperture will extend right through one of the wire holders, and be blind in the other wire holder. The second aperture is preferably of non-circular, generally substantially rectangular or oval, cross-section for close-fitting receipt of a multi-core drop-wire 18. The base of the first part may be unconnected to that of the second part, but we prefer that they be connected together, for example slidably connected together. One technique of slidable connection comprises telescoping of the first and second parts together, for example by telescoping of pins 38 mounted on one base into apertures in the other base. Sliding, or other movement of one base (or part in general) relative to the other results in a change in the separation between the two first apertures 10. Thus, a given adapter may be used on design of terminal block having different separations between its binding posts.

When the bases 3B are moved towards or away from each other it will in general be necessary that the wire-holders 37 be able to rotate, and preferably each is each of a pair is able to be angularly rotated about an axis of a respective first aperture therein without orbital rotation of one part about the other. Preferably the rotation allows the portion 16A and the other portion 16B of the second aperture to be and to remain mutually parallel since this will facititate insertion of the drop wire 18. The wire holders 36 may have a circular protrusion 39 at their undersides which allows rotational mounting in a surface of the base.

Such sliding of the bases 26 and rotation of the wire holders 3B will however result in the portions 16A and 16B becoming laterally separated. Since the amount of variation in spacing of the binding posts is unlikely to be very large, tolerance in the fit of the drop wire in the second aperture may be sufficient to allow insertion of the drop wire.

Figure 11A:
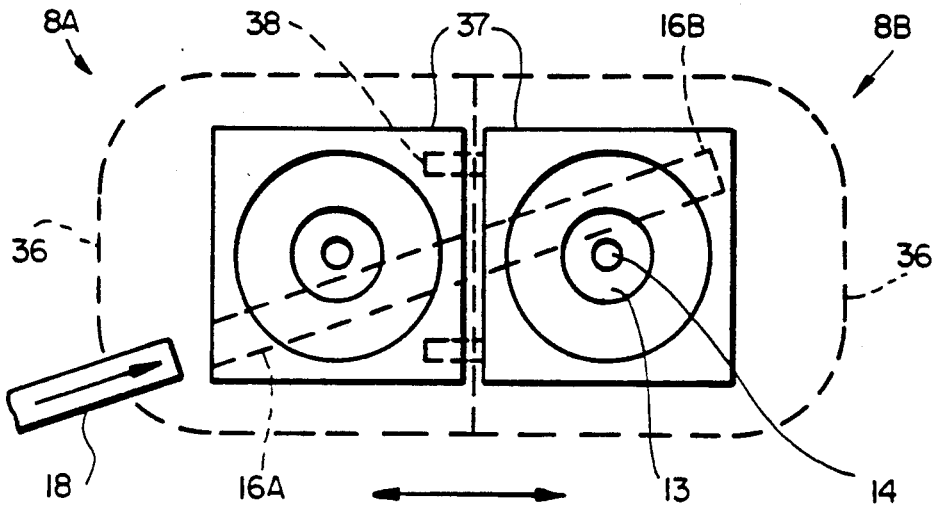
Figure 11B:
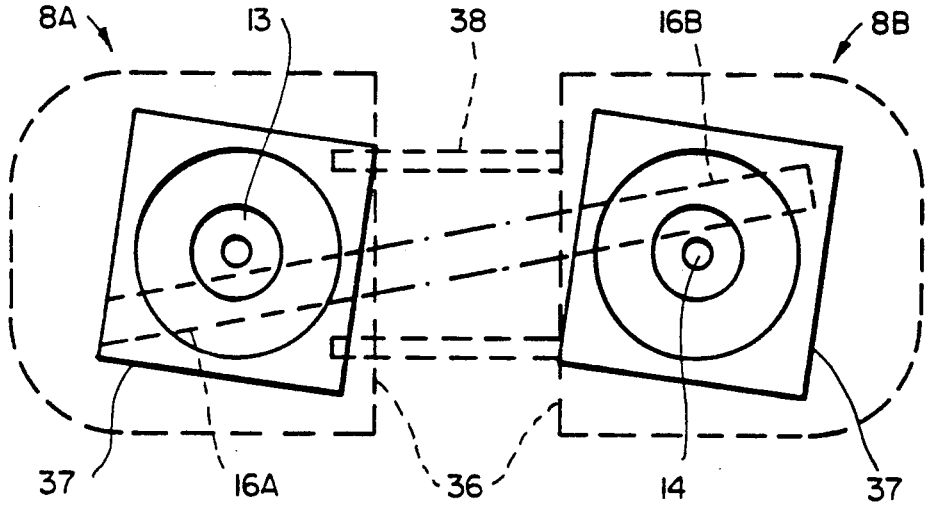

The effect of separtion of the bases 3B and rotation of the wire holders 37 is shown in FIGS. 11A and 11B.

Figure 12:
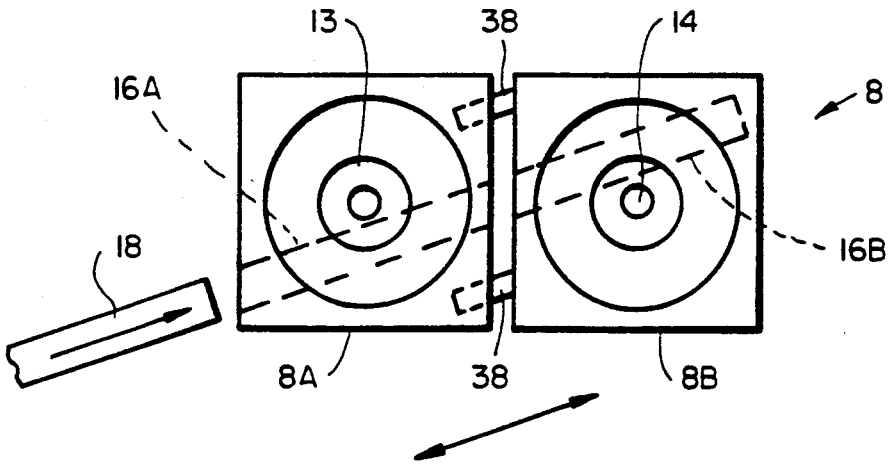

FIG. 12 shows a variation on the design of FIGS. 10 and 11, in which the first and second parts 8A, 8B are slidably fixed to each other, the direction of sliding being substantially parallel to a substantially straight line along which lie the portion 16A and other portion 16B of the second aperture. The pins 38 or other means can be seen to be set at the desired orientation, generally parallel to the portions 16A and 16B.

Figure 13:
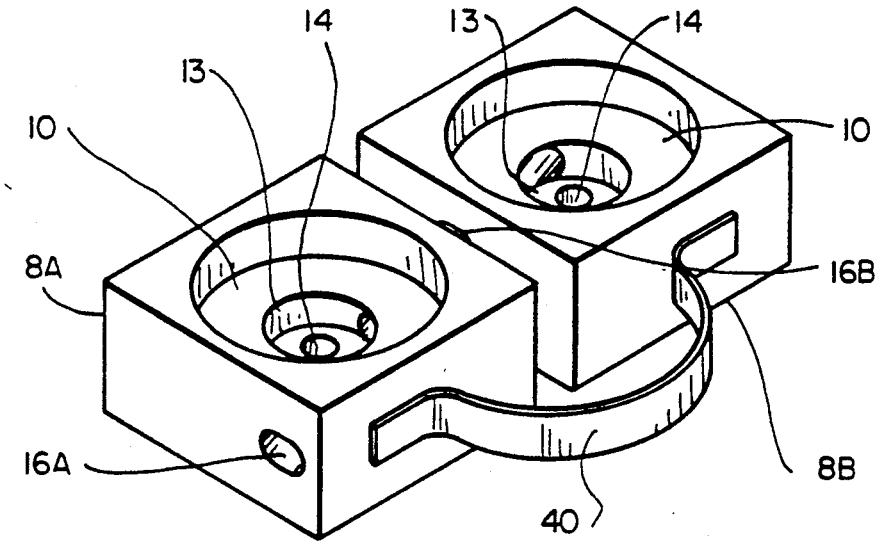

The adapter of FIG. 13 comprises a first part 8A and a second part 8B, each of which may be of unitary construction or made of two or more pieces that are fixed, preferably, immovably, together.

Each part has a first aperture 10 having an upper part 13 (as drawn) of larger diameter for receipt of a cap, and a lower part 14 of smaller diameter through which a binding post protrude. The first and second parts 8A, 8B may be interconnected by a flexible connector 40. The connector may comprise a wire, or cord or yarn, or a web of a material.

Such a connector 40 may be bonded to a surface of the parts 8A, 8B, may be inserted into a slot in the parts or may be integral with each part. If desired, the connector may be adjustable in the sense that the separation between the parts 8A and 8B can be altered and then at least temporarily fixed at the new value.

The first surfaces of the parts 8A, 8B (i.e. the undersides as drawn) may have a recess preferably substantially concentric with the first apertures, which recess may contain a sealing material such as a gel. Such a sealing material may provide an environmental seal around binding posts that enter the first apertures.

A part (8A or 8B) of the two part adapter of the general type shown in FIG. 13, but without the web 40 may be supplied and used alone, i.e. without the other of its pair, or they may be used in pairs but supplied without the web.

Figure 14A:
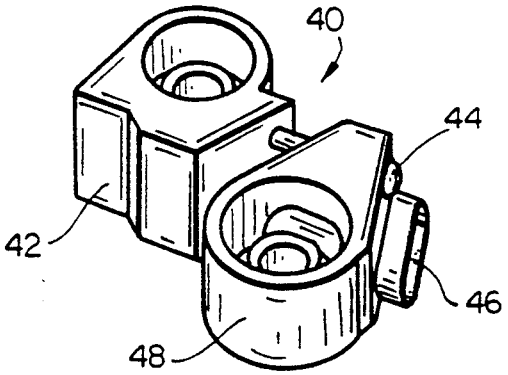
FIGS. 14*a* and 14*b* illustrate alternative adapter embodiments that can be adjusted to suit different binding post separations.
Figure 14B:
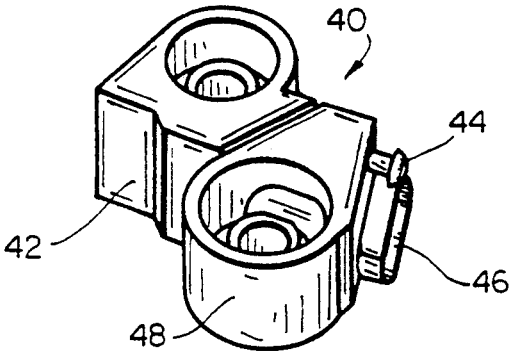
Figure 15:
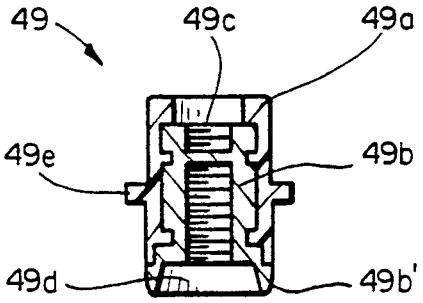
FIG. 15 is a cross-sectional view of an alternative embodiment of a binding post cap for the adapter of FIGS. 14*a* and 14*b*.

FIGS. 14*a* and 14*b* illustrate alternative adapter embodiments of the invention. More specifically, adapter 40 comprises two parts 42 and 48 wherein adapter section 42 includes a rod-like member 44 which slides within a passage way in adapter section 48 and along an oval member 46 sized to accept an oval drop wire. The oval aperture is open within the base of the adapter members 42 and 48 to permit the formation of an electrical contact as the binding post cap 49 is tightened on a binding post. More specifically, FIG. 14*a* illustrates the adapter 40 in the extended position sized to fit binding posts on terminals which are farther apart than the compressed format illustrated in FIG. 14*b* for binding posts which are closer together. FIG. 15 illustrates the binding post cap 49 having the metallic insert 49*b* with cutting edge 49*b*' The metal insert 49*b* is surrounded by the insulating cap 49*a*. The flanges 49*e* on the cap prevent the overtightening of the cap to sever small drop wires by bottoming out on the top of the adapter 42 or 48. The top and bottom of the cap 49*c* and 49*d*, respectively, are filled with suitable gel-like sealing material to prevent the ingress of moisture and provide for a sealed system.

Figure 16:
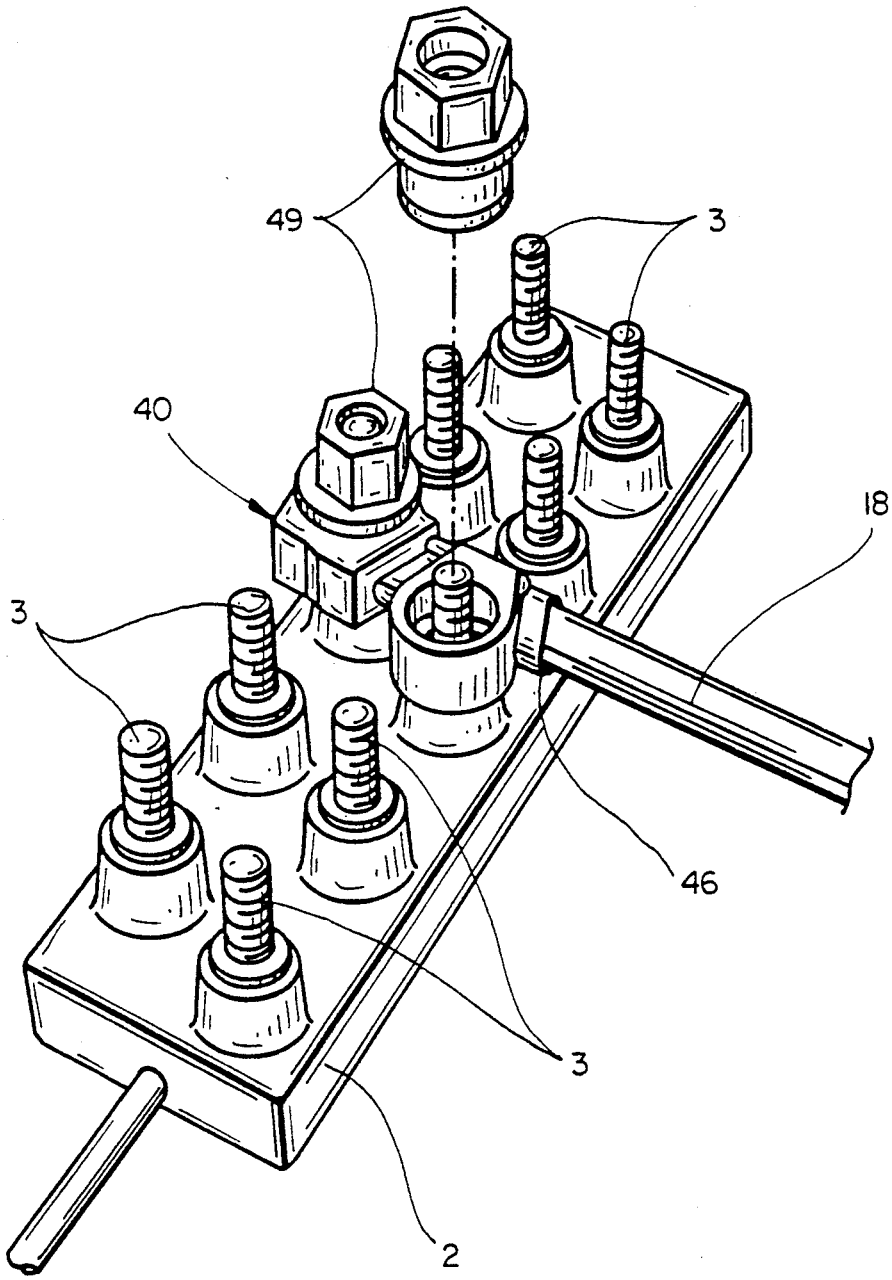
FIG. 16 illustrates the embodiments of FIGS. 14*a*, 14*b*, and 15 installed on a terminal block.

FIG. 16 illustrates the adapter 40 midway extended to accommodate tip and ring binding posts 3 of terminal block 2 with a drop wire 18 inserted through the oval tubular member 46. The figure also illustrates an installed binding post cap and a binding post cap 49 to be installed.

Figure 17:
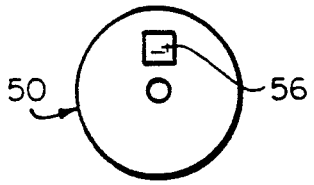
FIG. 17 illustrates an embodiment of a washer incorporating a metal wedge therein.
Figure 18A:
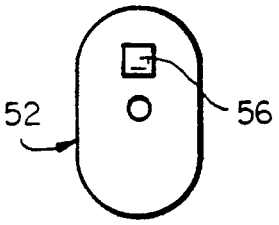
FIGS. 18*a*, 18*b*, and 18*c* illustrate an alternative embodiment of an oval washer containing a metal wedge capable of driving through the washer upon compression of the washer.
Figure 18B:
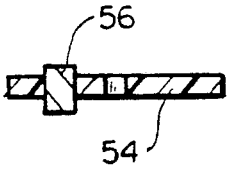
Figure 18C:
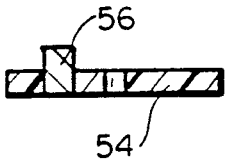

To provide for metal-to-metal contact between the binding post base 3*a* and the terminal 2, a unique washer is illustrated in embodiments of FIGS. 17 and 18*a* and 18*c*. FIG. 17 illustrates a round washer while FIG. 18*a* illustrates an oval washer preferably inserted into the base of adapter 40. The washer comprises a dielectric insulating section 54 and a metallic or optionally plastic wedge 56. If the wedge 56 is metal, upon tightening there will be a metal base in the terminal post to wire to metal cap contact whereas if the wedge 56 is plastic it merely prevents the creep of the insulation on the wire of the adapter binding post combination upon thermal cycling. FIG. 18*b* illustrates the washer prior to compression while FIG. 18*c* illustrates the washer after compression.

Figure 19A:
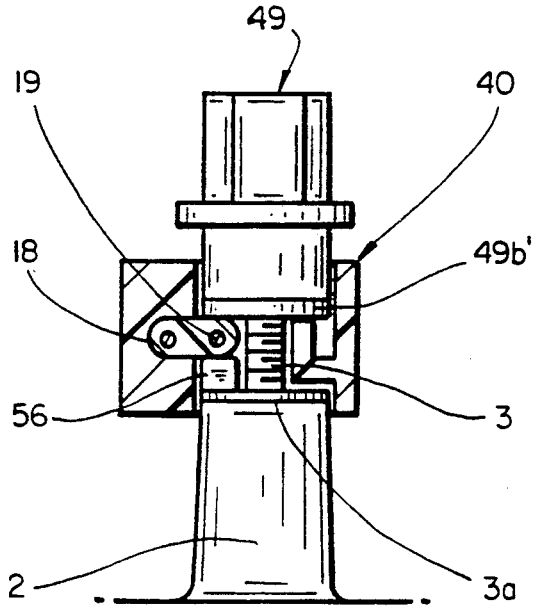
FIGS. 19*a* and 19*b* illustrate the movement of the wedge in FIGS. 18*b*, and 18*c* upon tightening of the cap adapter combination to form a metal-to-metal contact.
Figure 19B:
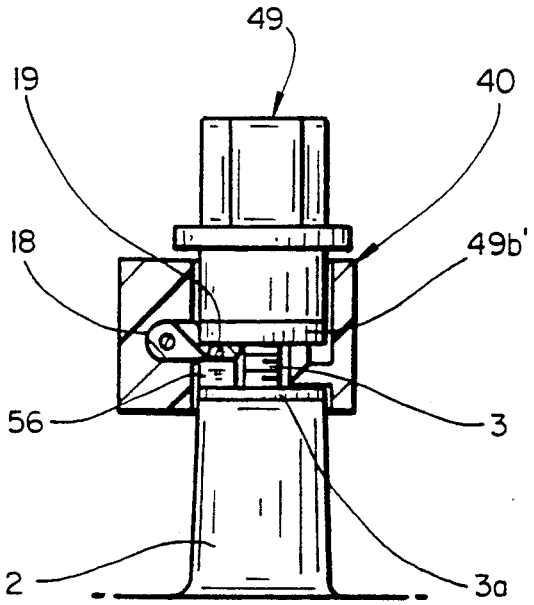

FIGS. 19*a* and 19*b* illustrate FIGS. 18*b* and 18*c*, respectively, wherein the washer is contained within a cross-sectional view of the adapter 40. More specifically, FIG. 19*b* illustrates the metal-to-metal contact formed the terminal post base portion 3*a* to the conductive core 19 of the drop wire 18 and the metal edge insert cutting edge 49*b*'.

Figure 20:
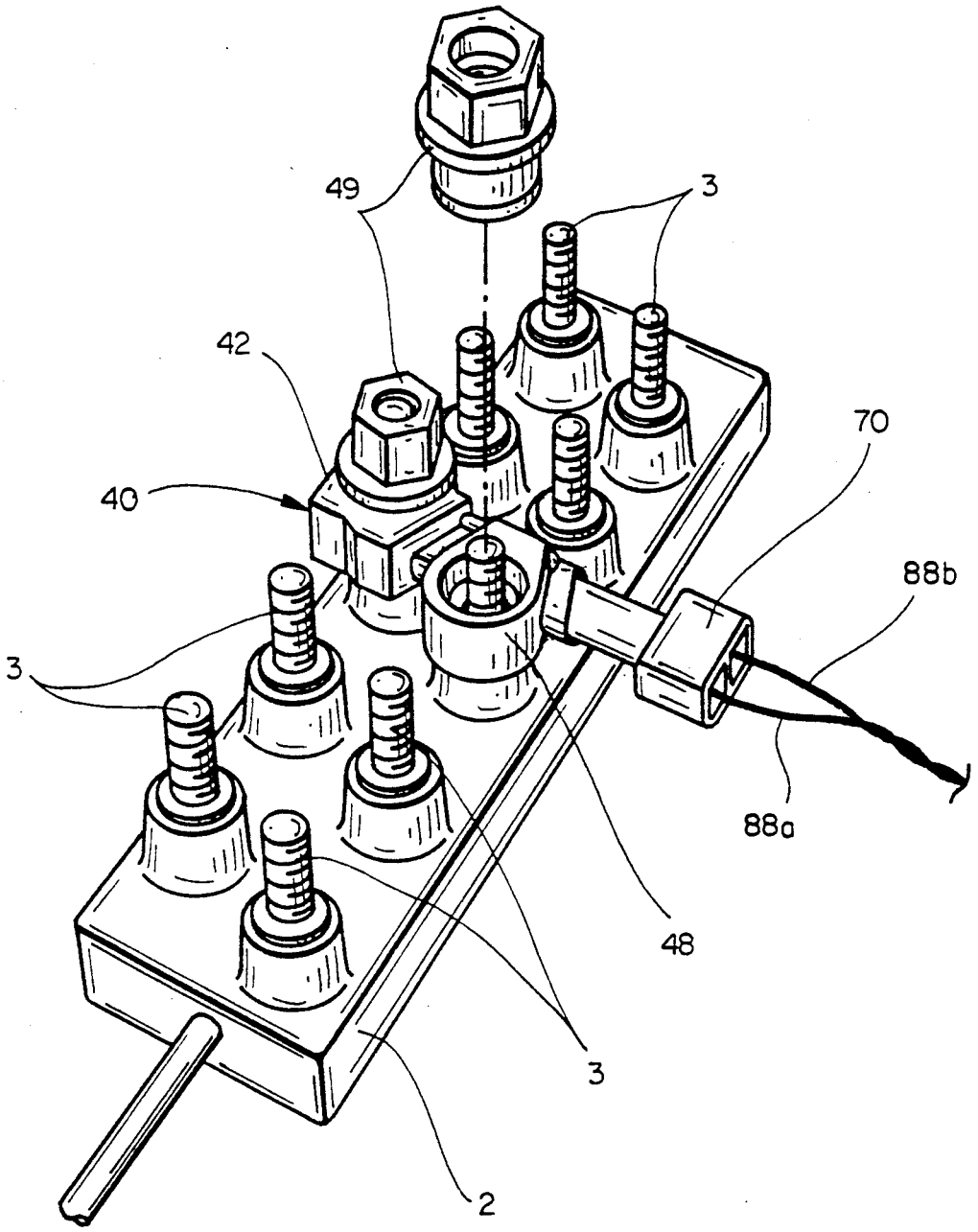
FIG. 20 illustrates the alternative embodiment installed on a terminal block wherein an adapter is used to accommodate small drop wires.

FIG. 20 illustrates a further alternative embodiment of the adapter 40 wherein an insert 70 having a cross-sectional dimension similar to standard oval drop wire is utilized as an adapter for individual fine drop wires 88*a* and 88*b*. The adapter 70 permits the formation of an electrical contact to the drop wires without the severing of the drop wires upon the tightening of the cap 49 onto the binding post 3 while engaging the binding post and the adapter 40.

For the avoidance of doubt it is here stated that the invention provides a terminal block, an adapter and components therefor, and methods, for making electrical connections, particularly in the telecommunications network, and particularly to multi-core cables. Any of the housing, cap, binding posts, cutters, sealing means, etc. may be chosen.

We claim:

1. An adapter by means of which cores of a multi-core drop wire can be connected to a pair of binding posts of a terminal block, which comprises:

(a) two caps that can be received on respective binding posts, and (b) a housing having:

(i) two first apertures each extending from a first surface to a second surface of the housing, the housing being positionable with the first surface adjacent the terminal block and the binding posts within respective said first apertures such that the posts can receive respective caps at the second surface, the caps extending within respective said first apertures; and (ii) a second aperture that passes between, and is in communication with each of, said first apertures, the second aperture being capable of receiving said drop wire such that respective cores thereof pass through respective first apertures and are contacted by respective caps when received by respective binding posts within the first apertures.

2. An adapter according to claim 1, in which the caps are threaded such that they can be screwed onto threaded binding posts.

3. An adapter according to claim 1, in which each cap has insulation displacement means which can displace insulation of a drop wire.

4. An adapter according to claim 1, in which each of said first apertures is of substantially circular cross-section.

5. An adapter according to claim 1, in which said second aperture is of non-circular cross-section such that the cores of a said drop wire therein of non-circular cross-section are maintained in fixed orientation with respect to said first apertures.

6. An adapter according to claim 1, in which said second aperture is elongate and closed in transverse cross-section.

7. An adapter according to claim 1, in which the housing has means that limits the extent to which the caps can be received within respective said first apertures.

8. An adapter according to claim 7, in which said means that limits comprises a shoulder within each of said first apertures, said apertures each being of greater size at the second surface than at said first surface.

9. An adapter according to claim 1, which additionally comprises:

(a) a sealing material at each of said first apertures and/or within each of said caps.

10. An adapter according to claim 9, in which said sealing material has a cone penetration value as measured by ASTM D217-68 at 21° C. of 100–350 (10–1 mm), and an ultimate elongation as measured by ASTM D638-80 at 21° C. of at least 200%.

11. An adapter according to claim 1, in which said second aperture is substantially straight.

12. An adapter according to claim 11, in which the housing has first and second sides that extend between the first and the second surfaces;

the second aperture terminating in an opening in said second side; and the first side having a substantially similar shape to the combined shape of the second side plus a substantially straight drop wire extending therefrom, such that two or more said adapters can be positioned side-by-side in substantially close packing configuration.

13. An adapter according to claim 1, in which the housing comprises first and second parts;

the first part having therein one of said first apertures and a portion of said second aperture;

the second part having therein another of said first apertures and another portion of said second aperture;

the first part being movable relative to the second part.

14. An adapter according to claim 13, in which orientation of the first part is fixed relative to that of the second part such that axes of the two first apertures are substantially mutually parallel and remain substantially mutually parallel on said movement of the first part relative to the second part.

15. An adapter according to claim 13, in which the first and second parts are unconnected to one another.

16. An adapter according to claim 13, in which said portion and said other portion of the second aperture are of non-circular cross-section and in which the second aperture breaks into each of the first apertures to such an extent that less than 67% of a transverse dimension of the second aperture lies within each first aperture.

17. An adapter according to claim 13, in which the first and second parts are connected together by a flexible web.

18. A kit which comprises a terminal block according to claim 13 and four said caps.

19. A kit according to claim 18, in which each of said caps has insulation displacement means.

20. A kit according to claim 18, in which each of said caps has a sealing material.

21. An adapter according to claim 13, in which the first and second parts may be arranged such that axes of said portion of the second aperture and of the other portion of the second aperture lie along a common substantially straight line.

22. An adapter according to claim 13, in which the first and second parts may be arranged such that axes of the two first apertures are substantially parallel, and the first part can be moved relative to the second part such that after the movement said axes remain substantially parallel and the distance between them has varied.

23. An adapter according to claim 22, in which the first and second parts can each be angularly rotated about an axis of a respective first aperture therein without orbital rotation of one part about the other.

24. An adapter according to claim 13, in which each of the first and second parts comprises:

a base; and a wire holder;

the wire holder being rotatably mounted in the base;

a part of the second aperture extending through at least part of the wire holder; the first aperture extending through the wire holder and the base; and the base of the first part being slidably fixed to the base of the second part such that the distance between axes of the two first apertures can be varied.

25. An adapter according to claim 24 in which each base has a recess therein at a surface opposite to that in which the wire holder is rotatably mounted, said recess being substantially concentric with said first aperture.

26. An adapter according to claim 25, in which said recess contains a sealing material.

27. An adapter according to claim 13, in which each of the first and second parts has a recess therein at said first surface, said recess being substantially concentric with the first aperture.

28. An adapter according to claim 27, in which said recess contains a sealing material.

29. An adapter by means of which cores of a multi-core drop wire can be connected to a pair of binding posts of a terminal block, which comprises: a housing having:

(i) two first apertures extending from a first surface to a second surface of the housing, the housing being positionable with the first surface adjacent the terminal block and the binding posts within respective said first apertures; and (ii) a second aperture that passes between, and is in communication with each of, said first apertures, the second aperture being capable of receiving said drop wire such that respective cores thereof pass through respective first apertures;

the housing comprising first and second parts; the first part having therein one of said first apertures and a portion of said second aperture;

the second part having therein another of said first apertures and another portion of said second aperture;

the first part being connected to and movable relative to the second part from a first relative position to a second relative position in each of which relative positions, axes of the two first apertures are substantially mutually parallel, and axes of said portion and of said other portion of the second aperture are substantially mutually parallel.

30. An adapter according to claim 29, in which the first and second parts are connected together by a flexible connector.

31. A terminal block by means of which conductors of a multi-core cable can be connected to the cores of at least two multi-core drop wires, which comprises a housing having:

(a) a first pair of binding posts, to respective posts of which respective cores of a first said drop wire can be connected, each post having means for connection to a conductor of said cable;

(b) a second pair of binding posts, to respective posts of which respective cores of a second said drop wire can be connected, each post having means for connection to a conductor of said cable;

each binding post being capable of receiving thereover a cap, such that when the cap is received by a binding post and over said drop wire adjacent the binding post contact is made to a core of the drop wire;

(c) a first aperture that passes between binding posts of the first pair, the aperture being capable of receiving a first said drop wire such that respective cores of the drop wire are adjacent respective binding posts of the first pair and can be individually contacted by caps thereon; and (d) a second aperture that passes between binding posts of the second pair, the aperture being capable of receiving a second said drop wire such that respective cores of the drop wire are adjacent respective binding posts of the second pair and can be individually contacted by caps thereon.

32. A terminal block according to claim 31, in which the binding posts are externally threaded such that internally threaded caps can be screwed thereon.

33. A terminal block according to claim 31, in which the housing has means that limits the extent to which the caps can be received on respective binding posts.

34. A terminal block according to claim 31, having from 2 to 25 pairs of binding posts and 2 to 25 aperatures.

35. A terminal block according to claim 31, in which each of the first and second apertures is non-circular in cross-section such that cores of a said drop wire of non-circular cross-section are maintained in fixed orientation with respect to said binding posts.

36. A terminal block according to claim 31, in which each of the first and second apertures is elongate and closed in transverse cross-section.

37. A terminal block according to claim 32, which additionally comprises a sealing material that can encapsulate said drop wires at positions adjacent the binding posts.

38. A terminal block according to claim 35, in which the sealing material has a cone penetration value as measure by ASTM D217-68 at 21° C. of 100–350 (10–1 mm), and an ultimate elongation as measured by ASTM D638-80 at 21° C. of at least 200%.

39. A method of connecting a multi-core drop wire to a terminal block having a pair of binding posts, by means of an adapter comprising two caps and a housing, the housing having:

(i) two first apertures each extending from a first surface to a second surface of the housing; and (ii) a second aperture that passes between, and is in communication with each of, said first apertures, the second aperture being capable of receiving said drop wire such that respective cores thereof pass through respective first apertures;

which method comprises:

(A) positioning the housing on the terminal block with the first surface adjacent the block and the binding posts within respective said first apertures;

(B) positioning the drop wire within the second aperture; and (C) positioning the caps on respective binding posts at the second surface such that the caps extend within respective said first apertures and contact respective cores of the drop wire.

40. A method according to claim 39, which additionally comprises providing a sealing material in said first aperture and/or in said caps, and subjecting the sealing material to compression around the drop wire.

41. A method according to claim 39, in which said drop wire is positioned within the second aperture without prestripping and without mutually separating its cores, the caps having insulation displacement means.

42. A method according to claim 39, in which the binding posts are threaded, and the caps are threaded, said steps of positioning the caps further comprising screwing the caps onto respective binding posts.

43. A method according to claim 39, in which the multi-core drop wire is formed by holding together end portions of two or more single cored drop wires in a holding means.

44. A cap suitable for use on a terminal block housing for connecting an insulated drop wire to a terminal of the housing, which cap comprises;

(a) a body having a male screw thread;

(b) a recess around the screw thread;

(c) a sealing material in the recess;

(d) an insulation-displacement cutting edge around the screw thread; and (e) an aperture which communicates with the screw thread and into which an electrical testing probe can be inserted for electrical connection to the screw thread.

45. A cap according to claim 44 which additionally comprises a plug by means of which said aperture may be temporarily closed.

46. An adapter according to claim 21, in which the first and second parts are slidably fixed to each other, the direction of sliding being parallel to said substantially straight line.

47. The adapter according to claim 46 in which the first and second parts are slideably fixed to each other with a rod-like member slideably engaging an aperture in the second part while the second part contains an tubular aperture open within the first and second parts to accept a drop wire and permit the sliding of the first part there along.

* * * * *